United States Patent [19]

Kemeny

[11] Patent Number: 4,986,160

[45] Date of Patent: Jan. 22, 1991

[54] BURST FIRING ELECTROMAGNETIC LAUNCHER UTILIZING VARIABLE INDUCTANCE COILS

[75] Inventor: George A. Kemeny, Pittsburgh, Pa.

[73] Assignee: Westinghouse Electric Corp., Pittsburgh, Pa.

[21] Appl. No.: 443,730

[22] Filed: Nov. 22, 1982

[51] Int. Cl.[5] ..... F41B 6/00

[52] U.S. Cl. ..... 89/8; 124/3; 307/106; 310/13; 323/340; 336/144

[58] Field of Search ..... 89/8; 124/3; 310/10–14, 182; 376/100, 108; 336/116, 137, 144, 150, 180, 229, DIG. 1, 149; 323/255, 256, 340, 341, 345, 360; 307/106, 107, 108; 315/243, 343, 344

[56] References Cited

U.S. PATENT DOCUMENTS

| | | | |
|---|---|---|---|
| 3,958,196 | 5/1976 | Benzie et al. | 336/144 X |
| 4,277,768 | 7/1981 | Burgeson et al. | 336/DIG. 1 X |
| 4,319,168 | 3/1982 | Kemeny | 318/135 |
| 4,329,971 | 5/1982 | Kemeny et al. | 124/3 |
| 4,343,223 | 8/1982 | Hawke et al. | 89/8 |
| 4,423,662 | 1/1984 | McAllister | 89/8 |
| 4,431,960 | 2/1984 | Zucker | 323/340 |
| 4,433,607 | 2/1984 | Kemeny | 89/8 |
| 4,433,608 | 2/1984 | Deis et al. | 89/8 |
| 4,437,383 | 3/1984 | Deis et al. | 89/8 |
| 4,458,577 | 7/1984 | Fisher et al. | 89/8 |

*Primary Examiner*—Stephen C. Bentley
*Attorney, Agent, or Firm*—R. P. Lenart

[57] ABSTRACT

An electromagnetic projectile launching system is provided with a pair of conductive projectile launching rails which are connected to a high current inductive power source. Current from an inductive energy storage coil is switched to the launcher rails to successively launch a series of projectiles. As each projectile is launched, the inductance of the coil is reduced to increase inductor current so that each successive projectile is launched at approximately the same muzzle velcoity.

25 Claims, 2 Drawing Sheets

BURST FIRING ELECTROMAGNETIC LAUNCHER UTILIZING VARIABLE INDUCTANCE COILS

BACKGROUND OF THE INVENTION

This invention relates to electromagnetic projectile launchers and more particularly to burst firing launchers wherein the total burst firing energy can be stored in an inductive energy storage coil.

Rapid firing electromagnetic projectile launcher systems have been proposed in which kinetic energy is stored by revving up the rotor of a kinetic energy storing generator. A fraction of this stored energy would be delivered for each acceleration of a projectile in such a manner that the firing current remains consistent for each shot, thus resulting in a uniform projectile muzzle velocity. Two types of systems have been deemed feasible, one involved a homopolar-inductor combination and the other a rotating pulse generator.

In the homopolar-inductor system, a homopolar generator charges an inductor to the firing current level, and suitable switching fires a projectile. This type of operation is described in commonly assigned copending application Ser. No. 256,745, filed Apr. 23, 1981, wherein some or all of the inductive storage is provided by bore flux augmenting conductors.

With the rotating pulse generator system, the generator produces distinct voltage pulses. In its simplest version, such a generator is connected to the breech rail terminals and, if the breech electrical loop is shorted by the presence of a projectile package, that projectile will be fired because the voltage pulse in combination with all the circuit and projectile-rail parameters results in the desired and consistent accelerating current variation. Barrel and bore configurations particularly suitable for use with a pulse generator are disclosed in commonly assigned copending application Ser. No. 256,745, filed Apr. 23, 1981. In addition, an or for use in such a system is disclosed in copending commonly assigned application Ser. No. 403,955, filed Aug. 2, 1982, now U.S. Pat. No. 4,836,083.

Both the homopolar-inductor and the pulse generator systems have the desirable feature of being able to store sufficient kinetic energy for many shots in a relatively compact, rotating generator. They both suffer the disadvantage that fully charging the rotating machine with sufficient energy for a maximum length burst may take two or three minutes and thus, for immediate rapid fire capability, the rotating machinery may have to remain revved up for hours, though not necessarily at the full speed and, hence, full kinetic energy level. A further drawback of both systems is that the firing rate will tend to decrease for successive shots, though this can be improved by auxiliary equipment or circuitry. In addition, both systems have high stator reaction torque during inductor discharging or firing. Although this can be alleviated by using two counter-rotating rotors for the kinetic energy storage generator, this in turn increases the generator size, weight and cost and complicates the system for accelerating the rotors. Therefore, it is desirable to design an electromagnetic projectile launching system wherein the energy for launching a succession of projectiles is delivered directly by the inductive energy storage means without necessarily supplying any additional energy to that inductance during the burst sequence. For example, the inductive storage means may, in the conventional manner, be charged to the desired first shot current level by a homopolar or other type of DC pulse generator and that generator may also remain connected to the inductive storage means during the firing sequence. However, the generator does not and normally cannot supply sufficient energy to maintain anywhere near constant current for very rapid successive launchings. Copending commonly assigned application Ser. No. 398,539, filed July 15, 1982 by Hughes et al., discloses a rapid burst firing electromagnetic launcher wherein the inductor-barrel system combination results in a significant increase in average bore flux for each successive shot of a burst, and thereby maintains substantially consistent muzzle velocity for each projectile of the burst, while the available launch current decreases.

SUMMARY OF THE INVENTION

An electromagnetic projectile launcher constructed in accordance with this invention comprises: a pair of conductive projectile launching rails; a source of high current including an inductive energy storage means; a switch for switching current from the source of high current to the pair of projectile launching rails to launch a projectile; and means for reducing the inductance of the inductive energy storage means following the launch of the projectile to again increase current flow through the inductive energy storage means in preparation for a launch of a second projectile.

The launchers of this invention accelerate a succession of projectiles in accordance with a method comprising the steps of: charging an inductive energy storage means to a predetermined current level; switching current from the inductive energy storage means into a pair of conductive projectile launching rails to launch a first projectile; reducing the inductance of the inductive energy storage means to increase current to a second predetermined current level; and switching current from the inductive energy storage means into the pair, or another pair, of conductive projectile launching rails to launch a second projectile.

In the present invention, a succession of projectiles can be rapidly launched without an increase in bore and barrel complexity, since a simple and single parallel rail launcher bore can fulfill the projectile acceleration requirements. However, the launcher complexity is concentrated in the inductor coil configuration which includes additional switches and circuitry so that the current can be successively raised back to the desired consistent launch current level. One advantage of this invention is that the additional complexity and weight are added to the stationary inductor coil while the barrel can remain simple and light thereby facilitating rapid aiming and following of rapidly moving targets.

DESCRIPTION OF THE PREFERRED EMBODIMENT

Figure 1:
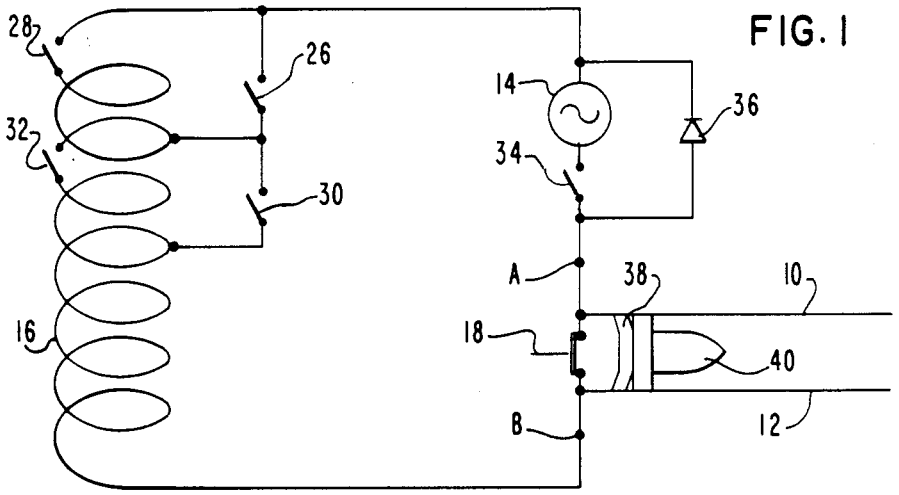
FIG. 1 is a schematic diagram of an electromagnetic projectile launching system constructed in accordance with one embodiment of this invention.
Figure 2:
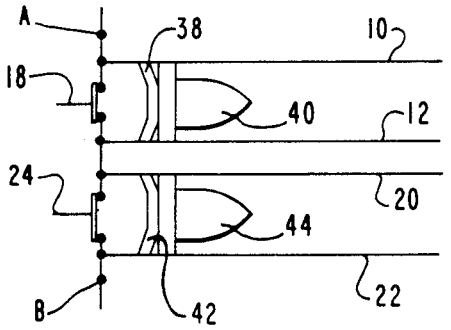
FIG. 2 is a schematic diagram of an alternative bore assembly for use in the launcher of FIG. 1.

Referring to the drawings, FIG. 1 is a schematic diagram of an electromagnetic projectile launching system in accordance with one embodiment of the present invention. A pair of conductive projectile launching rails 10 and 12 are connected to a source of high current comprising the series connection of a generator 14 and an inductive energy storage means such as coil 16. Switch 18 is connected across the breech end of projectile launching rails 10 and 12 and serves as a means for switching current from the high current source to the launching rails. Additional pairs of launching rails may be connected between points A and B as illustrated in FIG. 2 wherein a second pair of projectile launching rails 20 and 22 and a second switch 24 are also connected to the high current source. However, it will be apparent to those skilled in the art that a single pair of projectile launching rails can fulfill the requirements of this invention if a succession of projectiles is rapidly loaded between these rails during a launch sequence. Inductive energy storage coil 16 is provided with a plurality of switches 26, 28, 30 and 32 which serve as means for reducing the inductance of the coil following the launch of a projectile to increase current flow through the coil in preparation for a launch of a successive projectile. Switch 34 connects generator 14 to inductive energy storage coil 16 so that the coil 16 can be charged to an initial predetermined launch current. Crowbar device 36 provides a shunt current path around generator 14 so that total launch current need not flow through generator 14 during a burst firing sequence. A burst firing sequence is initiated by closing switches 18, 28, 32 and 34 while switches 26 and 30 remain open. This allows generator 14 to charge coil 16 to a predetermined firing current level. Once this firing current level has been achieved, switch 18 is opened, thereby switching current into projectile launching rails 10 and 12 and through sliding conductive armature 38 to launch projectile 40. After the first launch, switch 18 closes to reclose the high current source loop. Switch 26 closes to short out a portion of coil 16 and switch 28 then opens to remove that portion of coil 16 from the launcher circuit. This causes a reduction in the inductance of coil 16 and a resulting increase in current through coil 16 in preparation for the launch of a second projectile. Once the current has reached a second predetermined firing current level, which may be equivalent to the first firing current, switch 18 is again opened, thereby transferring current to projectile launching rails 10 and 12 and through a sliding conductive armature of a second projectile which has been loaded into the bore. Switch 18 is then closed and an additional projectile is inserted into the launcher bore. Then switch 30 is closed to short out a second portion of coil 16 and switch 32 is opened to remove that portion of coil 16 from the launcher circuit. This results again in an increase in the current through coil 16 to allow for the launch of another projectile. It will be apparent to those skilled in the art that each projectile launch results in a decrease in current through the inductive energy storage means and that the reduction of inductance of the inductive energy storage means results in an increase in current so that each successive projectile can be launched with substantially the same initial launch current.

If the bore configuration of FIG. 2 is used, the second projectile 44 will be launched by opening switch 24 thereby switching current through rails 20 and 22 and through sliding armature 42. It should be understood that additional bores can be used to launch additional projectiles or a reloading mechanism can be added so that successive projectiles can be launched from the same bore.

This invention allows the total burst energy to be prestored in an inductor. The initial energy storage $E_1$ just before firing the first shot is therefore:

$$E_1 = \tfrac{1}{2} L_1 I_1^2 \tag{1}$$

where $I_1$ is the initial breech current for the first shot, which may be fired in a simple parallel rail launcher, and $L_1$ is the initial inductor coil inductance. Immediately after, during, or just before the first projectile exits from the muzzle, the firing switch is rapidly reclosed and the energy balance in the inductor loop is now:

$$E_1 - \frac{K.E.}{n} = \tfrac{1}{2} L_1 (XI_1)^2 \tag{2}$$

where K.E. is the projectile kinetic energy, n is the efficiency, and $(XI_1)$ is the remaining inductor current at the point in time when the commutating or firing switch has reclosed. If the number of turns $N_1$ of the inductor is now lowered to a second number of turns $N_2$, the current will be increased and the applicable equations based on conservation of flux and energy are:

$$N_1(XI_1) = N_2 I_1 \tag{3}$$

$$\tfrac{1}{2} L_1 (XI_1)^2 = \tfrac{1}{2} L_2 I_1^2 \tag{4}$$

In the above equations, the left hand side represents conditions just after firing switch reclosure and the right hand side just after the change in coil turns and coil inductance which is required to raise the current back to the firing level of the first shot. These equations reduce to:

$$N_2 = XN_1 \text{ and } L_2 = X^2 L_1 \text{ or } \frac{L_1}{L_2} = \left(\frac{N_1}{N_2}\right)^2 \tag{5}$$

which simply states that for geometrically identical coils, the inductance is proportional to the number of turns squared, $N^2$.

To further illustrate the invention, the parameters of an example firing scenario have been calculated. For this example, an initial inductive energy storage of 10 MJ at a launching current of 0.5 MA has been assumed This requires an initial inductance of 80 $\mu$H. It is further assumed that there is no energy addition to the inductive energy storage coil during the burst and that the total energy dissipated per shot is precisely 1.0 MJ. This 1.0 MJ includes all losses, that is, not only the projectile kinetic energy and the normal ohmic and inductive losses, but also all switching losses, both those connected with the firing switch and also those connected with the switching required to change the coil inductance. For simplicity only, the 1.0 MJ energy dissipation has been lumped and assumed to occur during the firing.

Under these conditions, following the first shot, 1.0 MJ of energy has been dissipated, resulting in a remaining energy storage of 9 MJ and a remaining current of 0.474 MA with the inductance still remaining unchanged at 80 μH. A portion of the inductive energy storage coil is now eliminated from the circuit to reduce the inductance to 72 μH. This raises the current back to 0.5 MA for the next launch, and this procedure of reducing the coil inductance to raise the current back to a selected launch level continues for the desired number of shots, or until the stored energy is depleted.

Since the launch energy for successive projectiles is provided by an inductive energy storage coil which has successively less inductance, a gradual decrease in muzzle current of successive shots is expected. For the example shown, this muzzle current decay results in the velocity of the fifth shot being estimated to be about 1.8% less than the velocity of the first shot. If this velocity decrease is unacceptable, it can be avoided by overcompensating the inductance reduction, that is, by slightly raising the launch current for successive shots so that the RMS current level remains consistent for all shots. Alternatively, a deliberately higher current level can be achieved after each inductance change and the firing time can be delayed until the current, through normal decay in a resistance-inductance circuit, has reached precisely the desired launch level at which point the firing switch is opened. This latter method will somewhat decrease the efficiency because of increased ohmic losses.

During the burst sequence, closing switch 26 of FIG. 1 can be accomplished without difficulty since the voltage across its terminals prior to closure is at most a few tens of volts, for example, less than 50 volts under the example conditions. Thus, there will be no prestrike and essentially no switch deterioration as this switch has no current interruption function. Opening switch 28 is a more critical operation as this switch must: develop an arc voltage to rapidly perform its commutation functions; dissipate energy during the commutation; and finally interrupt the current in the abandoned coil turns. Rough estimates of the energy which will be dissipated in switch 28 can be made for the example conditions. The arc voltage developed across switch 28 terminals must assist in commutating the current so that it flows in the switch 26 line, that is, the coil turn bypass loop. If the bypass loop inductance is assumed to be 0.2 μH, then the switching losses during this commutation will be less than 25 kJ. The arc voltage developed across switch 28 terminals is essentially the driving force which causes the current in the loop external to the coil to increase to the predetermined firing current level. The inductance of this external loop should be made as low as possible but the stray inductance of the coil will now act just like the firing loop inductance. If the sum of the firing loop inductance plus the stray inductance of the coil is assumed to be 3.0 μH, then the losses during commutation associated with raising the current back to the predetermined firing level of 0.5 MA, can be estimated to be roughly 40 kJ. The losses associated with the transformer action whereby current which flows in the coil turns which are to be abandoned is caused to flow instead in the remaining active coil turns which link the same flux, is difficult to estimate but will be low, especially if the coil conductors are made of transposed cabling. Final arc interruption involves only low inductive energy dissipation because only the inductive energy storage associated with the stray inductance of the abandoned turns must be dissipated. A reasonable estimate for this loss is about 20 kJ.

Based on the above estimated switching losses, the total losses in abandoning coil turns to increase the current are in the order of 100 kJ for the example conditions, with most of this energy dissipation occurring in the arc of switch 28. In essence, this loss of 100 kJ is 10% of the energy dissipated per shot for the assumed conditions. With an arc voltage of 500 volts, it is further estimated that the switch 28 arcing will be completed in under a millisecond. To provide a better understanding of the relative magnitude of the estimated 100 kJ loss, the example conditions can be applied to a more conventional burst firing system in which the generator kinetic energy recharges the inductor coil back to the firing level for each shot. Under these circumstances, the charging back to the firing level is likely to require 15 milliseconds and the total circuit loop, with the now far lower inductance storage coil, may have a resistance of 50 μΩ. In that case, the ohmic losses during recharging will be about 180 kJ or about twice the switch 28 losses. It is therefore likely that the FIG. 1 type of configuration will be able to attain equal or better efficiency compared to the more conventional homopolarinductor burst firing system wherein the homopolar generator parcels out just sufficient additional energy for each successive shot.

If a single pair of projectile launching rails is to be used to fire a rapid succession of projectiles, then energy remaining stored in the launching rail inductance after the launch of one projectile can limit the initial acceleration of a succeeding projectile. For example, a simple parallel rail launcher of a bore length of 1.5 meters, will have a total bore inductance of about 1 μH. With a reasonable rail cross-sectional area commensurate with a launch current of 0.5 MA and using copper rails, the rail resistance will be about 200 μΩ and the time constant for current decay in the rails after firing becomes 5 ms. Assume that the firing switch reclosure after or during projectile exit plus the time for the inductance change to raise the current consumes 2 to 3 ms. This means that due to the inductive energy storage of the rail pair, there will still be a considerable reverse current flow through the firing switch at the point in time when the next projectile is ready to be launched. Under the example conditions, and for a launch 2.5 ms after the reclosure of the firing switch, the firing loop current and additionally a reverse current of 0.288 MA would be flowing through the firing switch. If a second projectile is to be launched at this instant, with a total firing loop current of 0.5 MA, the net armature current would be 0.212 MA. Therefore, the initial driving armature current is reduced by a factor of over 2 with a very substantial decrease in the initial accelerating force. If no provisions are made to increase the rate of current decay in the launcher rails after a launch, a somewhat longer barrel length will be required to attain the desired muzzle velocity. Furthermore, the reloading sequence may have to include special provisions to take into account and prevent problems due to the existence of this reverse current. However, the total parasitic energy storage in the rails for the example conditions is only 4% of 1 MJ and the velocity reduction will therefore be minor, while switch deterioration should be reduced.

Figure 3:
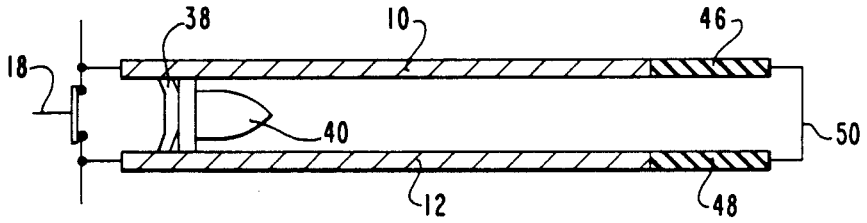
FIG. 3 is a cross-sectional view of a launcher bore for use with the launcher of FIG. 1.

Alternatively, remaining rail inductive energy can be dissipated in high resistivity rail segments. FIG. 3 is a cross-sectional view of a rail assembly including high resistivity segments 48 and 46 adjacent the muzzle ends of rails 10 and 12 with a means for shorting these high resistivity segments 50. For the rail assembly of FIG. 3, switch 18 should always close before projectile armature 38 bridges the high resistivity rail segments 46 and 48, so that the energy dissipated by the high resistivity rail segments is only the remaining rail inductive energy and not energy still being supplied from the inductive storage coil. If, for example, the high resistivity rail segments add 1 mΩ of resistance, then the remaining reverse current after 2.5 ms is only 24 kA and the remaining post-firing rail inductive storage is only 280 joules. At these low values, the muzzle velocity change will be insignificant.

All burst firing schemes where the total burst energy is prestored in a normally conducting inductor require very rapid firing so that efficiency does not excessively deteriorate due to ohmic losses. Thus, for the example conditions, a shot is fired every 3 ms. In order to allow time for reloading and also to prevent overheating of the launch rail contact faces, multiple bore arrays may be required. As shown in FIGS. 1 and 2, any number of barrels, each with its own dedicated firing switch may be connected in series with a high current source and fired successively. This will allow more time for barrel current decay between shots, result in less rail surface heating, and give more time for reloading. If desired, the number of barrels can be equal to the maximum number of shots in a burst, thus obviating all reloading during the burst.

Figure 4:
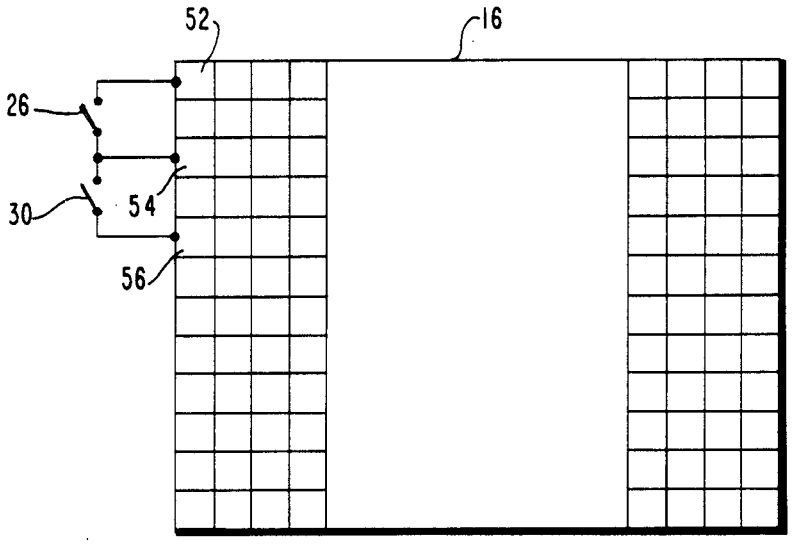
FIG. 4 is a cross-sectional view of a coil assembly which may be used in the launcher of FIG. 1 in accordance with this invention.
Figure 5:
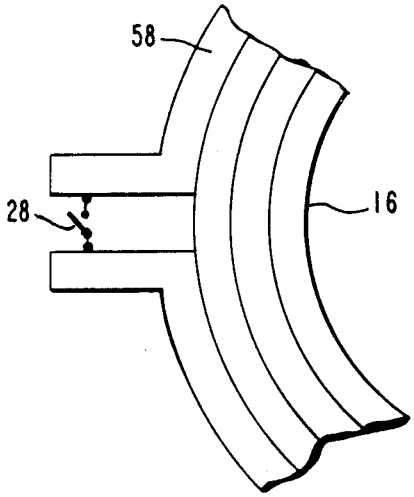
FIG. 5 is a top view of a portion of the coil assembly of FIG. 4.

The coil configuration shown in FIG. 1 was selected for illustrative purposes only, as this is not a favorable design. In essence, coil designs suitable for the launcher should be compact so that substantially all the magnetic flux links all the turns. The coils must be essentially air core coils since ferromagnetic circuits at below saturation level store insufficient energy, and rapid extraction of energy for highly oversaturated magnetic cores would then require adequate suppression of parasitic current flows in the iron. FIG. 4 is a crosssectional view of a favorable coil design for a five-shot scenario under the example conditions. FIG. 4 is a forty-eight turn coil wherein there are four layers with all layers in series and only the turns in the outer layer are successively shed by switches 26 and 30 connected to the coil circuitry as shown. Switch 26 is connected to short coil turns 52 and 54, while switch 30 is connected to short coil turns 54 and 56. FIG. 5 is a top view of a portion of the coil of FIG. 4 showing switch 28 which is connected in series with coil turn 58. An alternate coil of similar design to FIGS. 4 and 5 is a three-layer coil with sixteen turns per layer, all turns in series and some of the outer turns shed during firing. For a rather compact arrangement, such a coil could also be of Brooks design wherein the coil cross section is more nearly square with the bore radius equal to the coil height.

Figure 6:
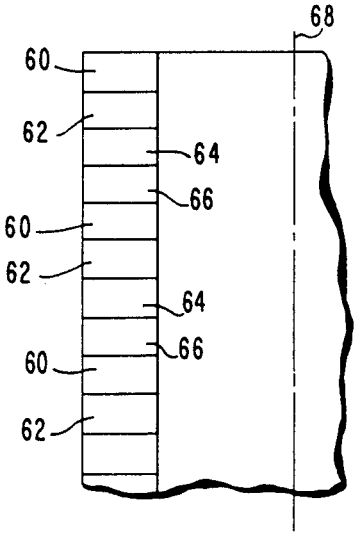
FIG. 6 is a partial cross-sectional view of an alternative coil assembly which may be used in the launcher of FIG. 1.

FIG. 6 shows a partial cross section of an alternative air core solenoidal design wherein the coil has forty-eight turns with four starts and all starts are connected in series. This results in four series-connected coils 60, 62, 64 and 66. In this case, all turns are accessible at the outer edge thus allowing more than only the five or six shots allowed by the FIG. 4 configuration, since any desired total number of turns can be shed. One complication of the design of FIG. 6 is that it requires external connections between .the end of one coil to the beginning, at the opposite end, of the next one. However, these connections can be made using multiconductor, parallel-plate bus designs to lower the lead inductance. If the FIG. 6 design were to use forty-eight turns and a single start coil, then shedding off, for example, three turns would in effect produce a substantial magnetomotive force discontinuity thus allowing more flux leakage than with the multistart design. The coil of FIG. 6 can be constructed in a toroidal design generated by bending center line 68 into a circle. Such a coil continues to yield complete accessibility of the coil turns and limits the fringe flux because it confines most of the flux to the core interior bore, which is highly desirable.

When all of the burst firing energy of an electromagnetic launching system can be prestored in an inductor, such a system becomes especially favorable if the inductor coil is superconducting. With a reasonably sized normally conducting or cryogenic inductive storage coil, energy retention in the coil for more than a fraction of a second or a few seconds, respectively, is not feasible and therefore such a system requires a means for rapidly transferring the required energy into the coil. Suitable means include a kinetic energy storage machine with a direct current or rectified output to rapidly charge the coil, or drawing rectified energy directly from a utility power line which has the requisite high-power delivery capability. Since the latter option is unlikely to be feasible for a land vehicle or airborne burst fire systems, such launchers based on this invention will require either kinetic energy prestorage or a high electric power pulse generating system, for example, a rocket driven turbine or magnetohydrodynamic generator.

If the inductive energy storage coil is constructed of superconducting conductors, then it becomes feasible to precharge this energy and store it in the coil, at very low system losses, until needed. Furthermore, with superconducting energy storage, a single shot can be fired and by then interrupting current flow in the external firing loop and letting the current flow only in the superconducting turns, firing the next shot can be delayed without causing any deleterious effects. For such a system, switches such as 26, 28, 30 and 32 of FIG. 1 should be located in a near absolute zero enclosure so that the coil has the minimum number of leads to the external environment and therefore minimum losses. Switches 28 and 32 could be constructed of superconducting links which are transformed into normal conduction during firing and therefore need not actually break the circuit. These switches would simply have to reduce current level in the abandoned turns to a point where that current is low enough to become insignificant. One additional important advantage of superconducting inductive storage is that, because of low losses, the energy transfer to the coil can be at a low rate with charging extending over hours or days, which makes such systems attractive for satellite systems where energy can be supplied by solar cells.

While the present invention has been described in terms of what at present is believed to be the preferred embodiment, it will be apparent to those skilled in the art that various changes and modifications may be made without departing from the invention. It is therefore intended that the appended claims cover all such changes and modifications which occur within the scope of the invention.

What is claimed is:

1. An electromagnetic projectile launcher comprising:

a pair of conductive rails, having a breech end and a muzzle end;

a source of high current including an inductive energy storage means having an initial inductance of sufficient magnitude to store enough energy to launch a plurality of projectiles;

a switch electrically connected across the breech end of said pair of conductive rails, for switching current from said source of high current to said pair of conductive rails to launch a first one of said plurality of projectiles; and means for reducing the inductance of said inductive energy storage means following a launch of said first projectile and after said switch has closed, to increase current flow through said inductive energy storage means and through said switch in preparation for a launch of a second one of said plurality of projectiles.

2. An electromagnetic projectile launcher as recited in claim 1, further comprising:

resistive rail segments connected to the muzzle end of said conductive rails; and means for connecting said resistive rail segments together and in series with said conductive rails.

3. An electromagnetic projectile launcher as recited in claim 1, wherein said inductive energy storage means comprises:

a superconducting conductor.

4. An electromagnetic projectile launcher as recited in claim 1, wherein said means for reducing the inductance of said inductive energy storage means comprises:

means for electrically disconnecting a preselected portion of said inductive energy storage means.

5. An electromagnetic projectile launcher as recited in claim 4, wherein said means for electrically disconnecting a preselected portion of said inductive energy storage means comprises:

a second switch connected in parallel with said preselected portion of said inductive energy storage means; and a third switch connected in series with said preselected portion of said inductive energy storage means.

6. An electromagnetic projectile launcher as recited in claim 4, wherein said preselected portion of said inductive energy storage means has an inductance magnitude such that current in said inductive energy storage means following the disconnection of said preselected portion, rises to equal current flowing before the first projectile launch.

7. An electromagnetic projectile launcher as recited in claim 1, wherein said inductive energy storage means comprises:

a coil having a plurality of turns wherein said turns are closely spaced such that substantially all magnetic flux of said coil links all of said turns.

8. An electromagnetic projectile launcher as recited in claim 7, wherein said inductive energy storage means coil is superconducting.

9. An electromagnetic projectile launcher comprising:

a first pair of conductive rails having a breech end and a muzzle end;

a source of high current including an inductive energy storage means having an initial inductance of sufficient magnitude to store enough energy to launch a plurality of projectiles;

a first switch electrically connected across the breech end of said first pair of conductive rails, for switching current from said source of high current to said first pair of conductive rails to launch a first one of said plurality of projectiles;

means for reducing the inductance of said inductive energy storage means following a launch of said first projectile and after said first switch has closed, to increase current flow through said inductive energy storage means and through said first switch in preparation for a launch of a second one of said plurality of projectiles;

a second pair of conductive rails having a breech end and a muzzle end; and a second switch electrically connected in series with said first switch and electrically connected across the breech end of said second pair of conductive rails, for switching current from said source of high current to said second pair of conductive rails to launch said second projectile.

10. An electromagnetic projectile launcher as recited in claim 9, wherein said inductive energy storage means comprises:

a superconducting coil.

11. An electromagnetic projectile launcher as recited in claim 9, wherein said inductive energy storage means comprises:

a coil having a plurality of turns wherein said turns are closely spaced such that substantially all flux of said coil links all of said turns.

12. An electromagnetic projectile launcher as recited in claim 9, wherein said means for reducing the inductance of said inductive energy storage means comprises:

means for electrically disconnecting a preselected portion of said inductive energy storage means.

13. An electromagnetic projectile launcher as recited in claim 12, wherein said means for electrically disconnecting a preselected portion of said inductive energy storage means comprises:

a third switch connected in parallel with said preselected portion of said inductive energy storage means; and a fourth switch connected in series with said preselected portion of said inductive energy storage means.

14. An electromagnetic projectile launcher as recited in claim 12, wherein said preselected portion of said inductive energy storage means has an inductance magnitude such that current in said inductive energy storage means following the disconnection of said preselected portion rises to equal current flowing to the first projectile launch.

15. A method of electromagnetically accelerating projectile, comprising the steps of:

charging an inductive energy store having sufficient inductance to store enough energy to launch a plurality of projectiles, to a predetermined current level;

switching current from said inductive energy store into a pair of conductive rails to launch a first one of said plurality of projectiles;

reducing the inductance of said inductive energy store to increase current through said inductive energy store and through a switch electrically connected across a breech end of said pair of conductive rails, to a second predetermined current level; and switching current from said inductive energy storage into said pair of conductive rails to launch a second one of said plurality of projectiles.

16. A method of electromagnetically accelerating projectiles as recited in claim 15, wherein said first predetermined current level is equal to said second predetermined current level.

17. A method of electromagnetically accelerating projectiles as recited in claim 15, wherein said step of reducing the inductance is accomplished by electrically shorting a preselected number of turns of said inductive energy store.

18. A method of electromagnetically accelerating projectiles as recited in claim 15, further comprising the steps of:

successively reducing the inductance of said inductive energy store to increase current to successive predetermined current levels; and successively switching current from said inductive energy store into said pair of conductive rails to successively launch additional projectiles.

19. A method of electromagnetically accelerating projectiles as recited in claim 16, further comprising the step of:

shorting the breech end of said pair of conductive rails during the launch of each of said projectiles just prior to a time when said projectiles bridge a pair of resistive rail segments adjacent to the muzzle end of said conductive rails.

20. A method of electromagnetically accelerating projectiles, comprising the steps of:

charging an inductive energy store having sufficient inductance to store enough energy to launch a plurality of projectiles, to a predetermined current level;

switching current from said inductive energy store into a first pair of conductive rails to launch a first one of said plurality of projectiles reducing the inductance of said inductive energy store to increase current through said inductive energy store and through a switch electrically connected across a breech end of said first pair of conductive rails, to a second predetermined current level;

switching current from said inductive energy store into a second pair of conductive rails to launch a second one of said plurality of projectiles.

21. A method of electromagnetically accelerating projectiles as recited in claim 20, further comprising the step of:

shorting said first pair of conductive rails following the launch of said first projectile and prior to the launch of said second projectile.

22. A method of electromagnetically accelerating projectiles as recited in claim 20, wherein said first predetermined current level is equal to said second predetermined current level.

23. A method of electromagnetically accelerating projectiles as recited in claim 20, wherein said step of reducing the inductance is accomplished by electrically shorting a preselected number of turns of said inductive energy store.

24. A method of electromagnetically accelerating projectiles as recited in claim 20, further comprising the steps of:

successively reducing the inductance of said inductive energy store to increase current to successive predetermined current levels; and successively switching current from said inductive energy store into additional pairs of conductive rails to successively launch additional projectiles.

25. A method of electromagnetically accelerating projectiles as recited in claim 20, further comprising the step of:

shorting the breech end of each of said pair of conductive rails during the launch of each of said projectiles just prior to a time when said projectiles bridge a pair of resistive rail segments adjacent to the muzzle end of each pair of said conductive rails.

* * * * *